US005692753A

United States Patent [19]

Falk

[11] Patent Number: 5,692,753

[45] Date of Patent: Dec. 2, 1997

[54] MARBLE AND DICE BOARD GAME AND METHOD OF USE

[76] Inventor: Janet M. Falk, 32 Strathmore Blvd., Sarasota, Fla. 34233

[21] Appl. No.: 733,612

[22] Filed: Oct. 17, 1996

[51] Int. Cl.[6] ..... A62F 3/00

[52] U.S. Cl. ..... 273/248

[58] Field of Search ..... 273/242, 243, 273/248, 249

[56] References Cited

U.S. PATENT DOCUMENTS

| | | | |
|---|---|---|---|
| D. 123,508 | 11/1940 | Moore | 273/248 X |
| D. 150,065 | 6/1948 | Dock | 273/248 X |
| 3,166,325 | 1/1965 | First | 273/248 X |
| 3,395,922 | 8/1968 | Garangiotis | 273/248 |
| 3,433,483 | 3/1969 | Ellis | 273/248 |
| 3,804,416 | 4/1974 | Jones et al. | 273/248 X |
| 5,067,722 | 11/1991 | Wesner | 273/248 |
| 5,386,994 | 2/1995 | Baranowski | 273/248 X |

FOREIGN PATENT DOCUMENTS

| | | | |
|---|---|---|---|
| 1407517 | 12/1965 | France | 273/248 |

*Primary Examiner*—William E. Stoll

[57] ABSTRACT

A marble and dice game board and method of play for up to four players that combines luck and skill such that players of all skill levels can play and enjoy the game. A marble and dice playing board is provided with indentations spaced around the board to form a path of play, player positions, starting base positions, game start positions and home positions. Each player is provided with a set of marbles, the starting order of the game is determined, a die or other type of random number generator is used to indicate the number of spaces to move the marble along the path of play, allowing a player to jump over other marbles and to send another player's marble back to its home position and start over, with the first player to get a complete set of marbles to that player's home position winning the game.

7 Claims, 1 Drawing Sheet

MARBLE AND DICE BOARD GAME AND METHOD OF USE

BACKGROUND

The invention relates generally to a marble and dice board game apparatus and method of play and, more particularly, to a marble and dice board game apparatus and its method of play that combines chance and skill in such a way that allows the game to be adapted and enjoyed by children as well as adults, along with allowing skilled players to compete against other skilled players or allow varying levels of skilled players to play at the same time and can be played by up to four individuals at one time.

Board games are a popular leisure time activity for children and adults. For a board game to be interesting and remain popular, it should combine luck and skill so as to allow players of different skill levels to play at the same time without giving an unfair advantage to those of greater skills; allow players of the same skill level to play at the same time; and allow very skilled players to compete against other skilled players and to be able to devise and improve on game winning skills. Since board games may be played by a wide variation of ages, the game should be able to be played by children against adults and still give the child playing against the adult some chance of being able to win, while still keeping the game interesting for the adult and allowing the adult to use skill in playing the game.

For the foregoing reasons, there is a need, therefore for a game board apparatus and method of play that is complex enough to allow skilled players to find the game interesting and be able to strategize and compete against other skilled players and to devise a strategy to win; while combining luck and skill in the game so as to allow skilled and unskilled players to compete at the same time; while keeping the interest of the skilled players and still allowing luck to give the unskilled or younger players a possible chance at winning the game; and yet being simple enough to allow unskilled or very young players to play and enjoy the game.

SUMMARY

The present invention is directed to a marble and dice board game apparatus and method of play that satisfies these needs. The present invention provides for a game board apparatus and method of play that is complex enough to allow skilled players to find the game interesting and be able to strategize and compete against other skilled players and to devise a strategy to win; while combining luck and skill in the game so as to allow skilled and unskilled players to compete at the same time; while keeping the interest of the skilled players and still allowing luck to give the unskilled or younger players a possible chance at winning the game; and yet being simple enough to allow unskilled or very young players to play and enjoy the game. The method of playing the game can be accomplished by using the board game apparatus, or alternatively the method of playing the game can be incorporated into a computer program so that the game can be played using a computer display, keyboard and mouse.

A marble and dice board game apparatus having features of the present invention comprises a multiple sided playing board with rounded indentations sized so as to hold a marble. The multiple sided playing board may be octagon shaped. The board may be made of any type of rigid or semi-rigid material of sufficient thickness to make the rounded indentations. The indentations are spaced around the board to form different play areas including a path of play, player positions, starting base positions, game start positions and home positions for up to four game players. The path of play is in a configuration of multiple straight lines positioned at right angles to each other. The marbles are moved along the path of play in a clockwise movement according to the number that the player rolls on a die. The player positions for up to four game players are locating on the playing board at right angles to each other and the starting base positions are located on a diagonal and to the left of each player position and hold a maximum of four marbles. The home positions for up to four game players are located in the center of each player position parallel to and in between the path of play.

The path of play for each player starts at a player position on the left of the home position and has a first straight line of six indentations, a second straight line of four more indentations at a right angle to the first line, a third straight line of three indentations at a right angle to the second line, a fourth straight line of five indentations at a right angle to the third line, a fifth straight line of five indentations at a right angle to the fourth line, and a sixth straight line of one indentation at a right angle to the fifth line. This forms the first half of the path of play and the remaining second half of play is a mirror image of the first half of play.

In the present method of playing the marble and dice board game, the players are provided with a board game apparatus, essentially as described above. Each player is provided with a set of four marbles in each player's starting base positions, with each player's set of marbles being distinguishable form another player's set by design, size or color. A die is provided for each player. A way of determining the starting order is provided and once the starting order and turn order of the players is determined the following steps are repeated until the set of marbles of one player has moved once along the complete path of play and has returned to the player's home positions. The player rolls the die, the player is allowed to move a marble out of its starting base position to the game start position only if a designated number is rolled on the die. If the designated number is rolled on the die, the marble is moved out of the starting base position to the game start position and then moved clockwise, the number of spaces to be moved being equal to the number rolled on the die. If a player has already moved one or more marbles out of the starting base position and has one or more marbles positioned along the path of play, the player can move one marble along the path of play the number of spaces equal to the number rolled on the die. If a player has already moved one or more marbles out of the starting base position and has one or more marbles positioned along the path of play, but still has one or more marbles in the starting base position, if the player rolls the designated number on the die, the player may choose between moving a marble out of the starting base positions or to move one marble along the path of play the number of spaces equal to the number rolled on the die. If a player rolls a number on the die and there are not enough spaces to move along the path of play, the player loses a turn. The player is allowed to jump over an opponent's marble and the player's own marble on the path of play and count the space jumped over towards the number rolled on the die. The player is allowed to send the marble of another player back to the other player's starting base position if the space occupied by the other player's marble is the same space to be occupied by this player according to number rolled on the die. Once a marble has reached its home position, it remains in that position and may not be sent back to the starting base position.

In the method of playing the marble and dice board game, the starting order can be determined in a number of alternate ways depending on the level of skill or ages of the players. One way is to have each player roll the die and allow the player with the lowest number to start, if two or more players roll the same low number, those players take a turn rolling the die until one rolls a number lower than the others and that player starts the game, and then the starting order of the remaining players is determined by going in a clockwise direction from the starting player. Another way is to determine the starting order by allowing the players to take turns starting with the player who rolls the lowest (or alternatively the highest) number and then the next lowest (or alternatively the highest) number goes next, and so forth.

This combination of luck in the roll of the die and strategy with regard to moving marbles along the path of play or out of the starting base position, along with the number of game pieces in play at the same time provides for a game board apparatus and method of play that is complex enough to allow skilled players to find the game interesting and be able to strategize and compete against other skilled players and to devise a strategy to win; while combining luck and skill in the game so as to allow skilled and unskilled players to compete at the same time, while keeping the interest of the skilled players and still allowing luck to give the unskilled or younger players a possible chance at winning the game; and yet being simple enough to allow unskilled or very young players to play and enjoy the game.

DETAILED DESCRIPTION

Figure 1:
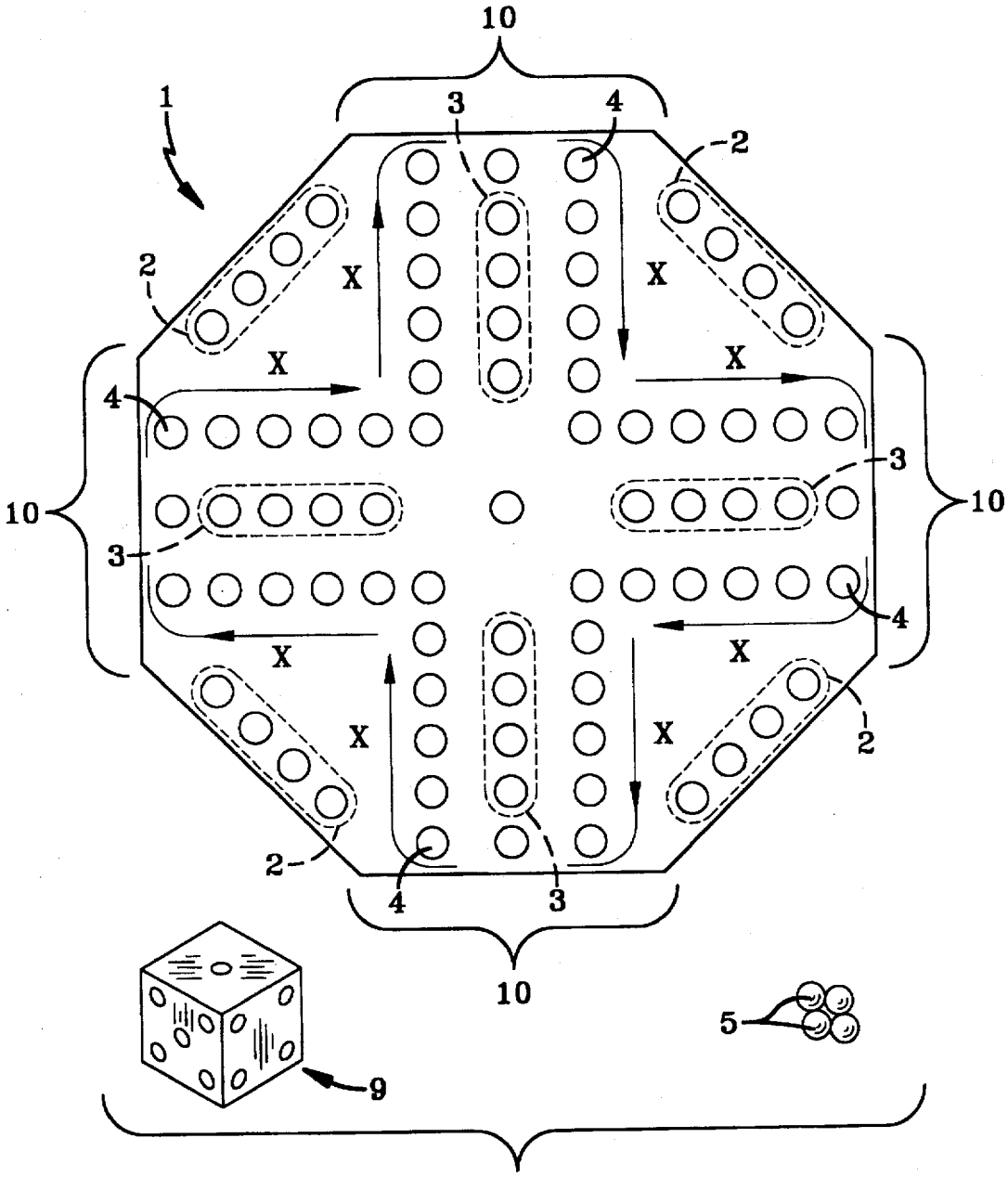
FIG. 1 shows a top plan view of a marble and dice game board along with a representative die and set of marble playing pieces embodying features of the present invention.
Figure 2:
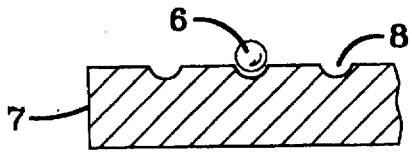
FIG. 2 shows a cross sectional view of the side of the marble and dice game board embodying features of the present invention.

Turning now to FIG. 1, a preferred embodiment of the device 1, is shown in accordance with the present inventive concepts. The apparatus comprises a multiple sided playing board 1 with rounded indentations sized so as to hold a marble. As shown in FIG. 2 a cross section 7 of the playing board 1 of FIG. 1, the rounded indentations 8 are deep enough and wide enough to hold an average sized marble 6. The indentations 8 shown in FIG. 2 are spaced around the board to form different play areas including a path of play X, player positions 10, starting base positions 2, game start positions 4 and home positions 3 for up to four game players. The path of play X is in a configuration of multiple straight lines positioned at right angles to each other. The marbles are moved along the path of play X in a clockwise movement according to the number that the player rolls on a die 9. The player positions 10 for up to four game players are locating on the playing board at right angles to each other and the starting base positions 2 are located on a diagonal and to the left of each player positions 10 and hold a set of marbles 5. The home positions 3 for up to four game players are located in the center of each player position 10 parallel to and in the middle of the path of play X.

The path of play X for each player starts at the game start position 4 at the player's position 10 and has a first straight line of six indentations, a second straight line of four more indentations at a right angle to the first line, a third straight line of three indentations at a right angle to the second line, a fourth straight line of five indentations at a right angle to the third line, a fifth straight line of five indentations at a right angle to the fourth line, and a sixth straight line of one indentation at a right angle to the fifth line. This forms the first half of the path of play and the remaining second half of play is a mirror image of the first half of play.

Turning now to FIG. 1, the present method of playing is as follows:

Each player begins with a set of four marbles 5, each set 5 being able to be distinguished from all other player's set, preferably by design or color. Each player's set of four marbles 5 is located in the starting base position 2 which is diagonal and to the left of each player position 10. Each player can roll the die 9 on the center of the board C, but if a player fails to remove that player's die after the player's turn is over, that player loses his or her next turn. Each player rolls the die 9 and the player with the lowest number starts play. If there is a tie, the players who tied repeat the roll of the die 9 until one of the player's rolls a number lower than the other. Alternatively, the lowest number rolled becomes the designated start number and every subsequent player must roll that number to move a marble out of the starting base position 2. In order to move a marble out of the starting base position 2, the player must roll a designated number, usually a one or a six or the number determined by the starting player. When this occurs, the player can move one of the four marbles 5 out of the starting base position 2 to the game start position 4 and then move the marble clockwise along the game board following the path of play X, with the number of spaces to be moved corresponding to the number rolled on the die 9. The sequence is repeated with other players. Once a player has moved at least one marble 5 out of the starting base position 2, if that player rolls the designated number, the player may choose to move another marble from the set 5 out of the starting base position 2 to the game start position 4 or may choose to move one of the marbles along the path of play X, the number of spaces moved being equal to the number on the die 9. If a player encounters the marbles of another player on the path of play X, the player may jump over the opponent's marble and count that space towards the number rolled on the dice 9. If the player finds the space the player is to occupy already occupied by an opponent's marble, the opponent's marble is sent back to the opponent's starting base position 2 and the player's marble occupies the space. The player continues to play so long as that player rolls the designated number. The object of the game is for a player to continue this method of play until one player's set of marbles 5 has been moved from their starting base position 2 along the path of play X and occupy the player's home position 3. If the player rolls the die 9 and there are not enough spaces remaining along the path of play, the player loses a turn. Once a marble occupies a home position 3, it cannot be removed by an opponent. The first player to get all the player's marbles 5 into the home position 3 wins the game.

Although the present invention has been described in considerable detail with reference to certain preferred embodiments thereof, other embodiments are possible. Therefore, the spirit and scope of the appended claims should not be limited to the description of the preferred embodiments herein.

What is claimed is:

1. A method of playing a marble and dice board game, comprising the steps of:

a. providing a multiple sided playing board having rounded indentations sized so as to securely hold a marble;

b. having indentations spaced around the board so as to form a path of play, player positions, starting base positions, and home positions for up to four game players;

c. forming the path of play in a configuration of multiple straight lines positioned at right angles to each other upon which marbles are moved in a clockwise movement along the path of play according to a number rolled on a die;

d. locating the player positions for up to four game players at right angles to each other;

e. locating the starting base positions for up to four game players on a diagonal and to the left of each player position, the starting base positions having up to four indentations; and f. locating the home positions for up to four game players in the center of each player position parallel to and surrounded by the path of play;

g. providing each player with a set of four marbles in each player's starting base positions, each player's set of marbles being distinguishable from another player's set by design, size, and color;

h. providing a means for determining the starting order of the players; and i. repeating the following steps until the complete set of marbles of one player has moved once along the path of play and has returned to its home position:

I. having the player roll the die;

II. allowing the player to move a marble out of its starting base position to the game start position only if a designated number is rolled on the die, and moving the marble out of the starting base position to the game start position and then move the marble clockwise some number of spaces along the path of play, the number of spaces moved being equal to the number rolled on the die;

III. allowing a player to move any marble a number of spaces along the path of play, the number of spaces being equal to the number rolled on the die;

IV. allowing the player who has moved one or more marbles out of its starting base position to choose between moving a marble out of its starting base position if a designated number is rolled on the die, or to move a marble already positioned within the path of play some number of spaces, the number of spaces moved being equal to the number rolled on the die;

V. allowing the player to jump over an opponent's marble and the player's own marble on the path of play and count the space jumped over towards the number rolled on the die;

VI. allowing the player to send another player's marble back to the other player's starting base position if the space occupied by the other player's marble is the same space to be occupied by this player according to the number rolled on the die;

VII. allowing a marble that has reached its home position to remain in that position and not be sent back to the starting position;

VIII. providing that if a player rolls a number on the die and there are not enough spaces to move along the path of play, the player loses a turn; and IX. allowing a player to continue playing so long as the player rolls the designated number; and X. providing that if a player fails to remove that player's die from the board game after the player's turn is over, that player loses a turn.

2. A method of playing a marble and dice board game according to claim 1, wherein in the providing a means for determining the starting order step, the starting order of the players is determined by having each player roll the die and allowing the player with the lowest number rolled on the die to start, and if two or more players roll the same lowest number, having each of those players take a turn rolling the die until no tie remains, and determining the order of the remaining players by going in a clockwise direction from the starting player.

3. A method of playing a marble and dice board game according to claim 1, wherein in the providing a means for determining the starting order step, the starting order of the players is determined by allowing the players to take turns starting with the player who rolls the lowest number followed by the player who rolls the next lowest number and so forth.

4. A method of playing a marble and dice board game according to claim 1, wherein in the providing a means for determining the starting order step, the starting order of the players is determined by having each player roll the die and allowing the player with the highest number rolled on the die to start, and if two or more players roll the same highest number, having each of those players take a turn rolling the die until no tie remains, and determining the order of the remaining players by going in a clockwise direction from the starting player.

5. A method of playing a marble and dice board game according to claim 1, wherein in the providing a means for determining the starting order step, the starting order of the players is determined by allowing the players to take turns starting with the player who rolls the highest number followed by the player who rolls the next highest number.

6. A method of playing a marble and dice board game according to claim 1, wherein the multiple sided playing board is octagon shaped.

7. A method of playing a marble and dice board game according to claim 1, wherein the designated number is chosen from the set consisting of one and six.

* * * * *